US008066203B2

(12) United States Patent
Zhou

(10) Patent No.: US 8,066,203 B2
(45) Date of Patent: Nov. 29, 2011

(54) MULTIFUNCTION SHOWER HEAD

(76) Inventor: Huasong Zhou, Fujian (CN)

( * ) Notice: Subject to any disclaimer, the term of this patent is extended or adjusted under 35 U.S.C. 154(b) by 424 days.

(21) Appl. No.: 11/428,721

(22) Filed: Jul. 5, 2006

(65) Prior Publication Data

US 2008/0017735 A1 Jan. 24, 2008

(51) Int. Cl.
*A62C 31/00* (2006.01)

(52) U.S. Cl. ..... 239/443; 239/446; 239/447; 239/449; 239/525; 239/556; 251/213; 251/248

(58) Field of Classification Search ..... 239/443, 239/446–449, 525, 556, 558, 587.1, 587.4; 251/213, 230, 248, 250.5
See application file for complete search history.

(56) References Cited

U.S. PATENT DOCUMENTS

| | | | | |
|---|---|---|---|---|
| 5,433,384 | A * | 7/1995 | Chan et al. | 239/449 |
| 5,476,225 | A * | 12/1995 | Chan | 239/449 |
| 6,076,743 | A * | 6/2000 | Fan | 239/447 |
| 6,367,710 | B2 * | 4/2002 | Fan | 239/449 |
| 6,622,945 | B1 * | 9/2003 | Wu et al. | 239/443 |

* cited by examiner

*Primary Examiner* — Steven J Ganey

(57) ABSTRACT

A switching device of a multifunctional shower head is integrated into the cavity of the shower head, which mainly includes a switching button, a radius bar, a swing arm, a coupled gear, a shaft for the coupled gear, a division gear, and a shaft for the division gear; wherein one end of said radius bar extends out of the shower head via a through-hole to fix with a switching button, and the end has a pivot pin; one end of said swing arm is fixed onto the shaft of the coupled gear, while a slot guide is disposed on the other end for connecting with said pivot pin of said radius bar; said gearing coupled and division gears are located in the cavity of the shower head via their shaft respectively; said division gear closing on the outlet of the main body has several dividing holes coordinating to the outlet of the main body.

1 Claim, 3 Drawing Sheets

MULTIFUNCTION SHOWER HEAD

BACKGROUND OF THE INVENTION

1. Field of the Invention

The present invention relates to a multifunctional shower head, and more particularly to a switching device of a multifunctional shower head.

2. Description of Prior Art

In conventional technology, most of multifunctional shower heads work in a similar way, i.e. the water spraying mode is operated manually by turning the switching collar to make the water divider to rotate relative to the shower head main body. Accordingly, said shifting collar is disposed between the spray panel and the main body for the switching collar to coordinate to the spray panel.

The structure of most conventional shower heads mentioned above is in general limited to a shower head of a small diameter, simply because it is more user-friendly to operate a switch of a small-sized shower head than otherwise. The present invention provides a user-friendly switching device for a shower head to overcome the above disadvantage.

OBJECTS AND SUMMARY OF THE INVENTION

It is therefore an object of the present invention to provide a user-friendly switching device for a multifunction shower head.

To achieve the above-mentioned goal, the present invention provides a switching device integrated inside the cavity of a shower head, which is mainly comprised of a switch button, a radius bar, a swing, a coupled gear and a division gear; wherein one end of said radius bar is extended out of the shower head via a through-hole to fix with said switch button, while the other end of said radius bar has a pivot pin; said swing arm is fixed on the shaft of the coupled gear with one end, the other side is possessed of a slot guide for connecting with said pivot pin of said radius bar; said gearing coupled and division gears are located in the cavity of the shower head via their own respective shaft; said division gear closing on the outlet of the main body has several dividing holes coordinating to the outlet of the main body, to rotate said division gear relative to the outlet of main body can carry out shifting spraying state.

Said division gear is pushed to touch against the outlet of the main body by having one end of said pressure spring around the shaft for said division gear fixed under the shower head, and the other end of said pressure spring fixed to said division gear.

Said through-hole of the shower head is drilled on the spray panel.

Said through-hole of the shower head is drilled on the back side of the main body.

Based on the above disclosure, when in use, a user turns the switching button to rotate the radius bar, which in turn (by means of the connection of the pivot pin and the slot guide) rotate the swing arm, and spin the coupled gear (via the locking of the both gears) the division gear is thus turned relative to the outlet of the main body.

To recapitulate, the switching button works by turning said radius bar, said swing arm and said coupled gear. Therefore, the specific structure of the switching button is not confined by either the shape or the size of a shower head. And as such, the switching device disclosed in the present invention is applicable to any shower heads.

DETAILED DESCRIPTION OF PREFERRED EMBODIMENTS

Figure 1:
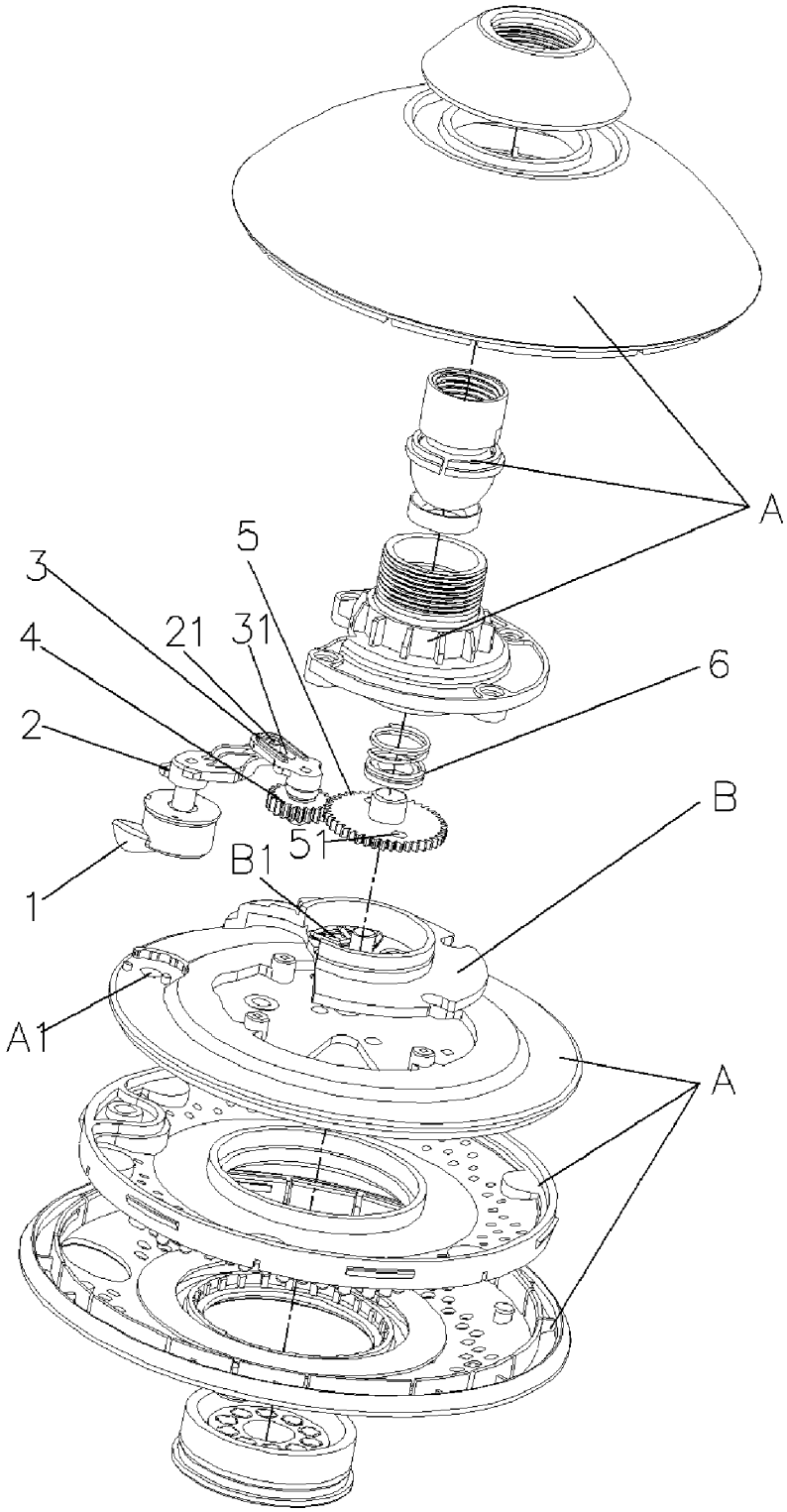
FIG. 1 is an exploded view of the present invention.
Figure 2:
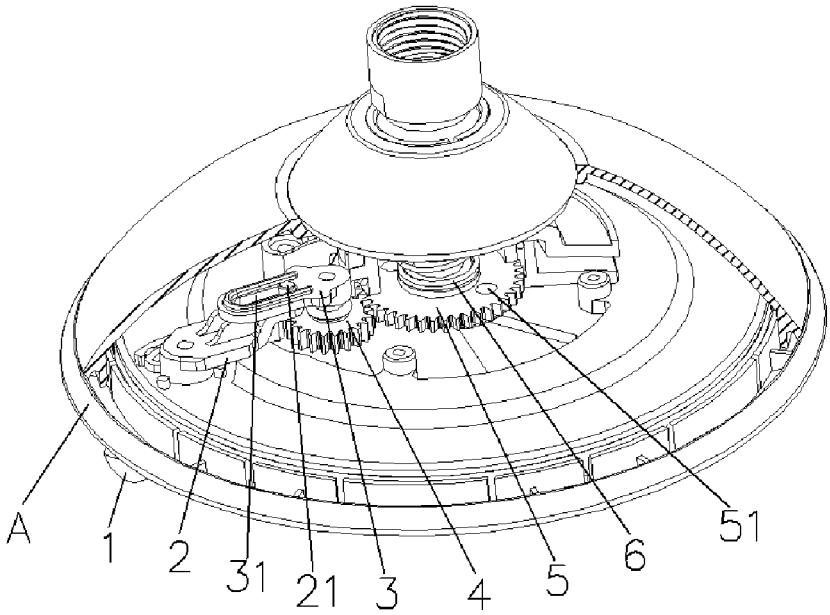
FIG. 2 is a perspective sectional view showing the combination state of the present invention.

Referring to FIG. 1 and FIG. 2, a switching device of a multifunctional shower head with through-hole A1 disclosed in the present invention is mainly comprised of a switching button 1, a radius bar 2 with two ends, a swing arm 3, a coupled gear 4 and a shaft, a division gear 5 and a shaft, and a spray panel.

Figure 3:
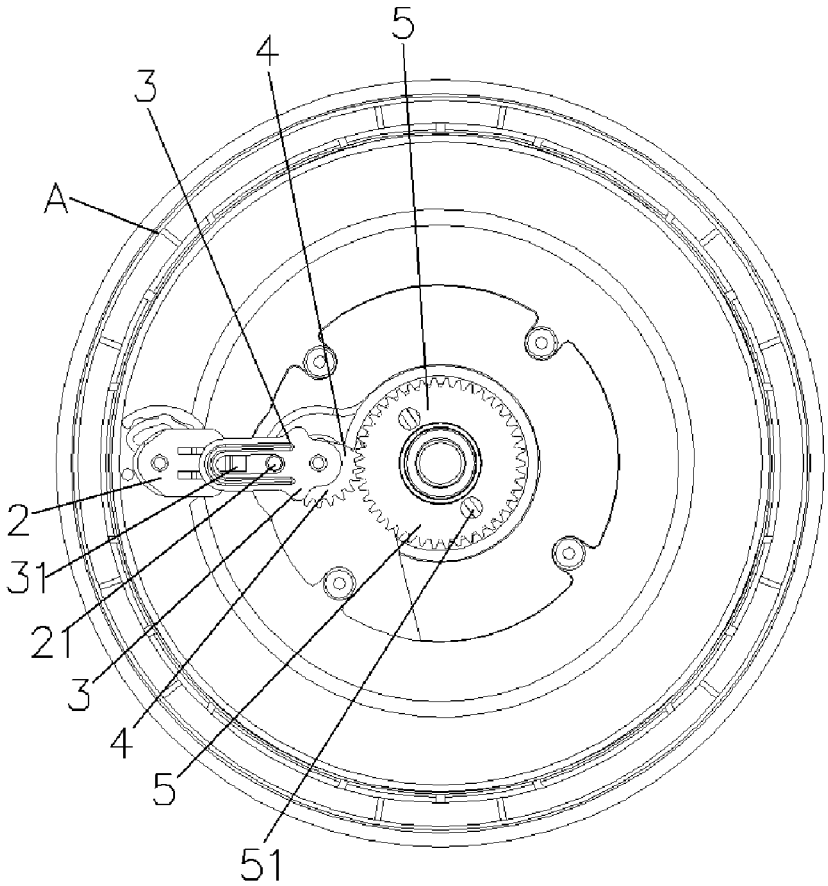
FIG. 3 is a top side view showing the combination state of the present invention.
Figure 4:
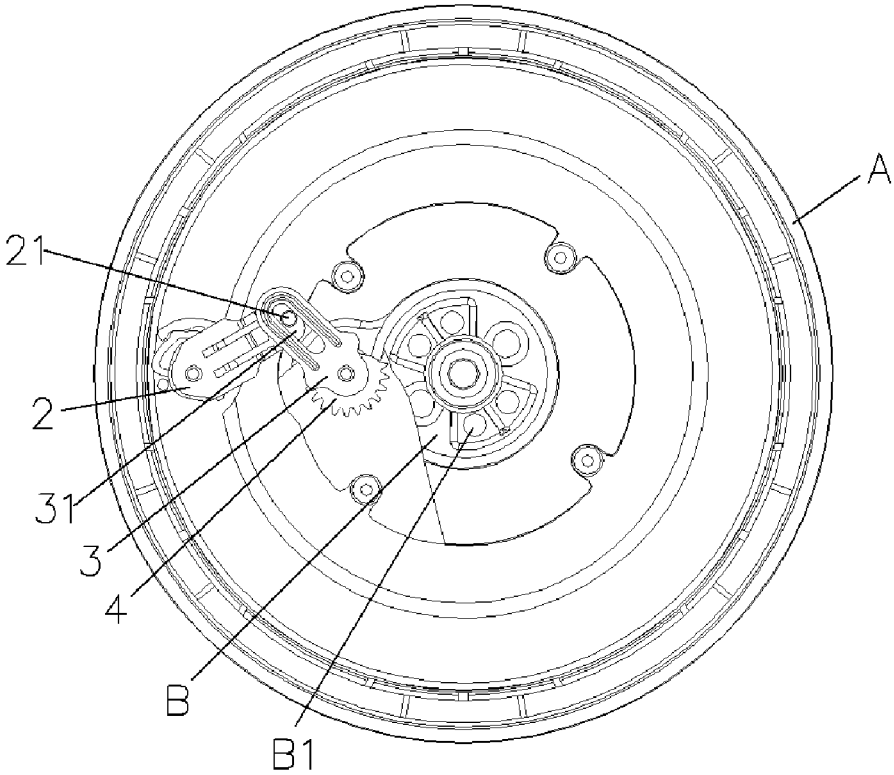
FIG. 4 is a top side view showing the rotating action of the present invention.
Figure 5:
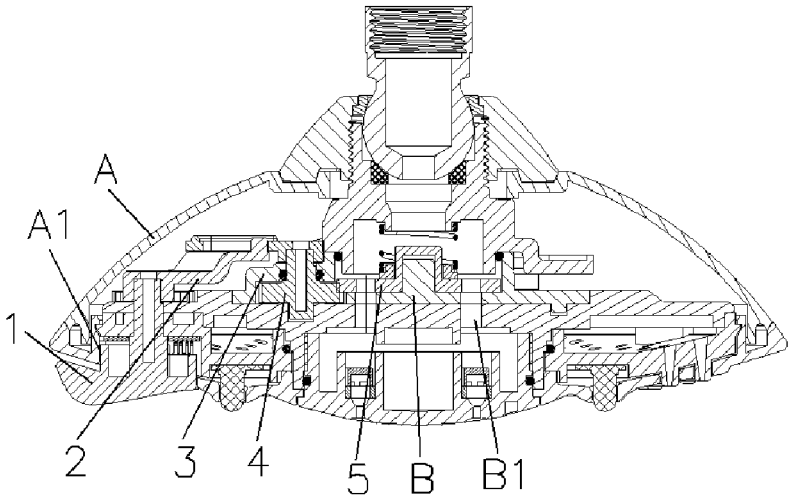
FIG. 5 is a cross-section view showing the combination state of the present invention.

One end of said radius bar 2 extends out of the shower head A via a through-hole A1 of said shower head to fix onto the switching button 1; another end of said radius bar has a pivot pin 21. Said through-hole A1 of the shower head A is disposed on the spray panel (as shown in FIG. 3) or on the back side of the main body (not shown in drawings).

Said swing arm 3 is fixed on the shaft of the coupled gear 4 with one end, the other side is possessed of a slot guide 31 for connecting with said pivot pin 21 of said radius bar 2, by means of the connection of the pivot pin and the slot guide, the swing arm 3 can be linked with said radius bar 2 in gang action.

Said gearing coupled 4 and division gears 5 are located on the cavity of the shower head A via their shaft respectively.

For closing to enough tight meanwhile rotating freely, said division gear 5 is pushed to touch against the outlet B of the main body by setting upon a pressure spring 6 on the shaft with fixing one end on the inside wall of the shower head A and another on the division gear 5, said pressure spring 6 not only pushes the division gear 5 to touch against the outlet B of main body tightly, but also assists the division gear 5 rotation in shifting operation.

Based on the statement above, division gear 5 operates by the turning of the switching button, which is in turn activates said radius bar 2, said swing arm 3, and said coupled gear 4; accordingly, the specific structure or physical appearance of the switching button 1 is not restricted by the shape and size of the shower head A; the shower head provided in the present invention is applicable to shower heads of any sizes or shapes.

I claim:

1. A switching device of a multifunctional shower head which includes a shower-head cavity, a shower head through-hole, and a shower head outlet, wherein said switching device includes i) a switching button, ii) a radius bar with two ends, wherein one end thereof extends out of said shower head via said shower head through-hole for fixing onto said switching button, and, the other end thereof further includes a pivot pin;

iii) a coupled gear, further including a coupled gear shaft disposed in said shower head cavity;

iv) a swing arm with two ends, wherein one end thereof is fixed to said coupled gear shaft, and the other end thereof includes a slot guide for fixing with said pivot pin of said radius bar;

v) a division gear, further including dividing holes for coordinating with said shower head outlet, and a division gear shaft disposed in said shower head cavity; said division gear locking with said coupled gear to rotate said dividing holes relative to said shower head outlet; and vi) a pressure spring, wherein one end is fixed under the shower head and the other end is disposed around said division gear shaft, by which said division gear is pushed against said shower head outlet.

* * * * *